United States Patent [19]

Ruuskanen

[11] 4,202,505

[45] May 13, 1980

[54] REFINER

[76] Inventor: Erkki Ruuskanen, Kenraalintie 5 B 17, 37620 Valkeakoski 2, Finland

[21] Appl. No.: 970,398

[22] Filed: Dec. 12, 1978

[30] Foreign Application Priority Data

Jan. 12, 1978 [FI] Finland ..... 780101

[51] Int. Cl.[2] ..... B02C 7/14

[52] U.S. Cl. ..... 241/247; 241/261.2

[58] Field of Search ..... 241/246, 247, 248, 261.2, 241/261.3

[56] References Cited

U.S. PATENT DOCUMENTS 3,717,309 2/1973 Luker et al. ..... 241/247

*Primary Examiner*—Mark Rosenbaum

*Attorney, Agent, or Firm*—Haseltine, Lake & Waters

[57] ABSTRACT

Refiner comprising a feed means feeding material to be refined, such as wood chips or paper pulp, into a gap between grinding disks and comprising a tubular jacket housing a feed screw rotating about its axis and having in its top surface an aperture for material infeed from a container located above and into the jacket, and said refiner comprising at least one rotating grinding disk. The feed screw has been connected by a coupling to the rotating disk and derives its rotary motion from the rotary motion of the grinding disk.

3 Claims, 1 Drawing Figure

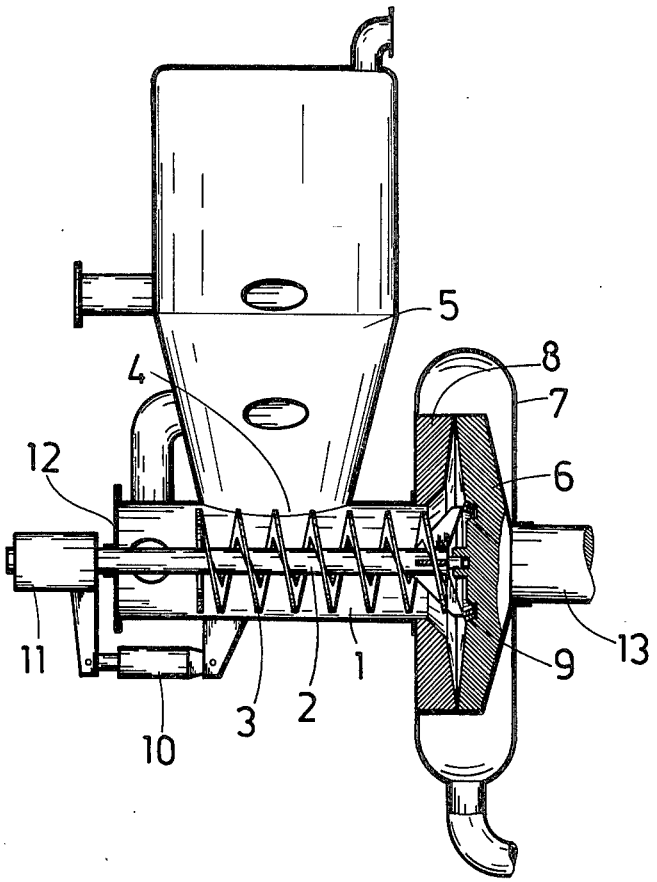
5
8
7
4
12
6
11
1
9
13
3
2
10

REFINER

Grinder refiners of this type present the drawback that a separate drive machinery is requires to rotate the conveyor screw. The drive machinery and the control units therewith connected increase both the manufacturing costs and the maintenance costs.

The object of the present invention is to eliminate the drawbacks mentioned. The grinder refiner of the invention is characterized in that the feed screw has been connected with a coupling to the rotating grinding disk and obtains its rotary motion from the rotary motion of the grinding disk.

The invention enables the requisite rotation to be obtained for the feed screw by a simple and reliable constructional design from the same drive machinery which also drives the grinding disk. As the rotational motion of the grinding disk and the grinding stop, the rotational movement of the feed screw also stops and the infeed of pulp into the gap between the grinding disks comes to an end.

A favourable embodiment of the invention is characterized in that the coupling between the feed screw and the grinding disk is a friction clutch. It becomes possible hereby to adjust the speed of rotation of the feed screw to be lower than that of the grinding disk if necessary. The feed screw may also be stopped altogether.

Another embodiment of the invention is characterized in that the feed screw may be loaded in its axial direction by means of a pressure cylinder in the direction towards the grinding disk and that it can be distanced therefrom. Hereby it becomes possible, hydraulically for instance, to control the slip of the friction clutch. At the same time an axial force directed on the rotating grinding disk is obtained, which eliminates any bearing play that could cause harmful contact of the blades with each other in case in a trouble situation the material to be refined should suddenly vanish from within the blade gap. The pressure cylinder may also be used to pull the feed screw off the blade for the duration of blade change.

A third embodiment of the invention is characterized in that the pressure cylinder is connected to a thrust bearing set-up mounted on the end of the rotational shaft of the feed screw, this shaft passing through the end face of the tubular jacket. Hereby it becomes possible by a simple design to transmit the force of the pressure cylinder to the friction clutch.

The invention is described in the following with the aid of an example and with reference to the attached drawing presenting the refiner of the invention, as a sectional view.

The feed means of the refiner comprises a tubular jacket 1, housing a feed screw 3 rotating about its axis defined by the shaft 2. The jacket 1 has in its top surface an aperture 4 for feeding in material from the container 5 located on top, into the jacket 1. The refiner features one rotating grinding disk 6 and one stationary grinding disk 8 affixed to the frame 7. The feed screw 3 is connected by the friction clutch 9 to the rotating grinding disk 6 and it obtains its rotary motion from that of the grinding disk. The feed screw 3 can be loaded in axial direction by means of the pressure cylinder 10 against the grinding disk 6 and it can be distanced therefrom. The pressure cylinder 10 has been connected with a thrust bearing assembly 11 mounted on the end of the rotation shaft 2 of the feed screw 3, which shaft passes through the end plate 12 of the tubular jacket 1. Since the feed screw 3 has been connected by the coupling 9 to the rotating grinding disk, a simple and reliable design solution has been created by which the requisite rotational motion for the feed screw is obtained from the same drive machinery which also rotates the grinding disk by the shaft 13. The pressure cylinder 10 may be used to control, hydraulically for instance, the slip of the friction clutch 9, and at the same time an axial force acting on the rotating grinding disk 6 is produced, which eliminates the bearing play that might give rise to undesirable contact of the blades 6,8 in case in a trouble situation the material that is being ground should suddenly escape from the gap. For the duration of change of the blades 6,8 the feed screw may be pulled away from the blades by the aid of the pressure cylinder 10.

It is obvious to a person skilled in the art that various embodiments of the invention may vary within the scope of the claims following below. For instance, the conical friction clutch 9 depicted in the example may equally well be replaced with any other coupling known in itself. The loading of the clutch need not be accomplished by the aid of the pressure cylinder 10: it may equally well be arranged mechanically, by means of spring loading.

I claim:

1. Improvement in a refiner, including feed means feeding material to be ground, such as wood chips or paper pulp for instance, into a gap between grinding disks, a tubular jacket housing, a feed screw rotating about an axis defined by its shaft, said jacket having in a top confining wall an aperture for feeding in of material from a container located thereabove and into said jacket, said refiner having at least one rotating grinding disk, said feed screw being connected by a coupling to the rotating disk and derives its rotary motion from the rotary motion of the grinding disk, the improvement comprising said feed screw being axially loadable with the aid of a pressure cylinder against the grinding disk and can be distanced therefrom.

2. Refiner according to claim 1, wherein the coupling between the feed screw and the grinding disk comprises a friction clutch.

3. Refiner according to claim 1, wherein said pressure cylinder is connected to a thrust bearing assembly mounted on one end of the rotational shaft of said feed screw, said shaft passing through an end face of said tubular jacket.

* * * * *